United States Patent [19]

Tyner

[11] 4,346,676

[45] Aug. 31, 1982

[54] TWO-CYCLE V-ENGINE WITH INTEGRALLY CAST EXHAUST MANIFOLD

[75] Inventor: Alfred E. Tyner, Fond du Lac, Wis.

[73] Assignee: Brunswick Corporation, Skokie, Ill.

[21] Appl. No.: 64,120

[22] Filed: Aug. 6, 1979

[51] Int. Cl.[3] ..... F01P 3/02; F01P 3/12

[52] U.S. Cl. ..... 123/41.74; 123/41.31; 123/41.44; 123/41.82 R; 123/55 VS

[58] Field of Search ..... 123/41.31, 41.44, 41.47, 123/41.72, 41.74, 41.75, 41.82 R, 55 VS, 52 MV, 55 R, 55 VF, 55 VE, 55 V, 195 R; 60/323

[56] References Cited

U.S. PATENT DOCUMENTS

| | | | |
|---|---|---|---|
| 1,454,315 | 5/1923 | Cushman | 123/41.44 |
| 2,504,973 | 4/1950 | Gehres | 123/41.31 |
| 2,627,256 | 2/1953 | Kiekhaefer | 123/41.79 |
| 2,856,121 | 10/1958 | Buehler | 123/195 R |
| 3,161,182 | 7/1964 | Albinson et al. | 123/55 VS |
| 4,082,068 | 4/1978 | Hale | 123/41.82 R |
| 4,092,958 | 6/1978 | Hale | 123/55 VS |
| 4,212,281 | 7/1980 | Ernest | 123/41.72 |

FOREIGN PATENT DOCUMENTS

| | | | |
|---|---|---|---|
| 651848 | 2/1929 | France | 123/52 MV |
| 1535903 | 12/1978 | United Kingdom . | |

*Primary Examiner*—Craig R. Feinberg
*Assistant Examiner*—W. R. Wolfe
*Attorney, Agent, or Firm*—O. T. Sessions

[57] ABSTRACT

The exhaust manifold for a water cooled, two-cycle, V-6, crankcase compression, outboard motor engine is cast integrally with the engine cylinder block. The manifold forms one wall of a central cooling passage.

1 Claim, 5 Drawing Figures

TWO-CYCLE V-ENGINE WITH INTEGRALLY CAST EXHAUST MANIFOLD

BACKGROUND OF THE INVENTION

This invention relates to an internal combustion engine and particularly to the exhaust and cooling systems for a two-cycle crankcase compression V-engine for use in outboard motors.

Water cooled V-type outboard motor engines typically have their exhaust manifolds placed between the cylinder banks with a water jacket outside the manifold at the top of the V. In such engines the manifold has been formed of two segments which must be carefully joined to avoid water leakage into the manifold which may cause damage to the pistons and cylinders.

SUMMARY OF THE INVENTION

In a water cooled, two-cycle V-block, crankcase compression, outboard motor engine the exhaust manifold is cast integrally with the engine block and located between the cylinder banks. Because the exhaust manifold is integral with the cylinder block no water leakage into the manifold and cylinders is possible.

DESCRIPTION OF THE PREFERRED EMBODIMENT

Figure 1:
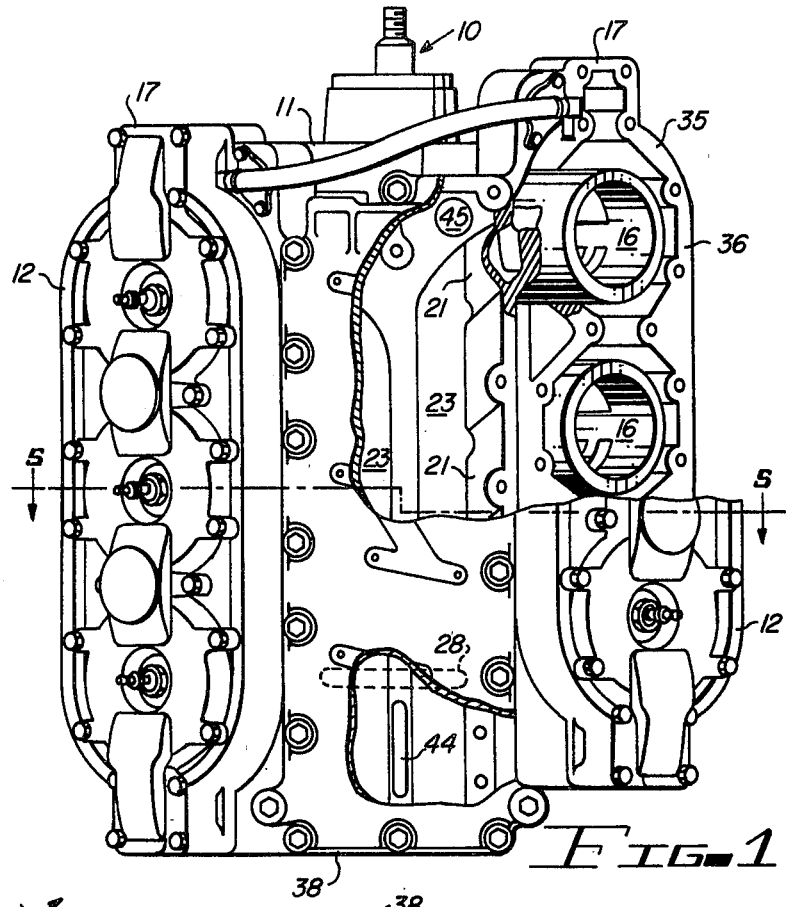
FIG. 1 is a broken away rear view of an engine.
Figure 2:
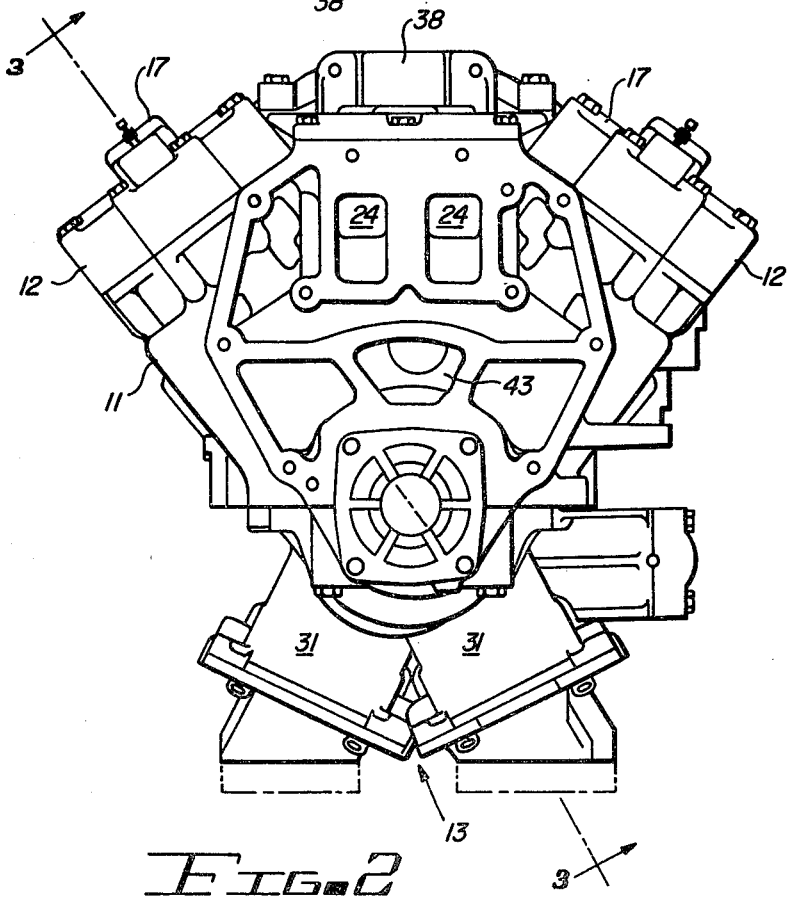
FIG. 2 is a bottom view of the engine.
Figure 3:
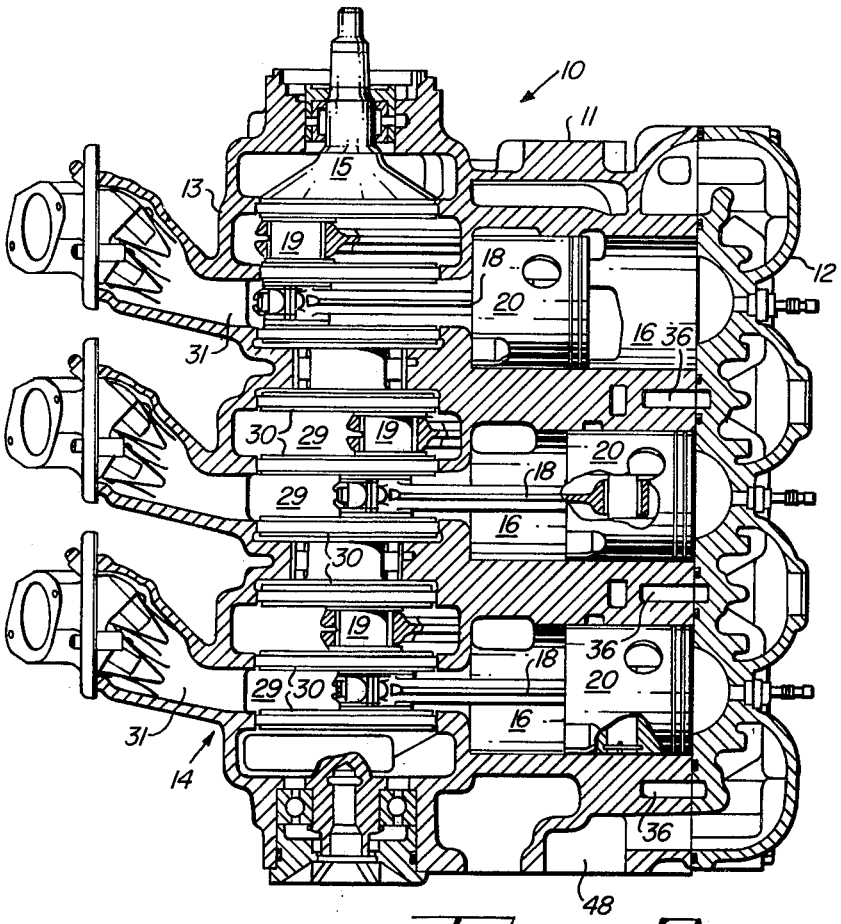
FIG. 3 is a section of the engine taken on line 3—3 of FIG. 2.

The figures illustrate a two-cycle, V-6 engine 10 particularly designed for use in an outboard motor. The engine includes a cylinder block 11 having two cylinder heads 12 and an intake manifold casting 13 defining, with the base or apex of the block, a crankcase 14 within which a crankshaft 15 is rotatably mounted. The cylinder block 11 is sand cast and includes six cylinders 16 arranged in two banks 17 forming a 74° V, the two banks 17 being vertically offset with respect to each other to offset the connecting rods 18. The rods 18 are journalled on crank pins 19 of the crankshaft 15 and pinned to the pistons 20.

The integral sand cast aluminum block 11 has an integrally cast tuned exhaust system including a port extender 21 from the exhaust port 22 of each cylinder 16, the extenders 21 from each cylinder bank 17 connecting to a corresponding exhaust gas chamber 23. The exhaust gas chambers 23 open downwardly, through openings 24 at the bottom of the block 11, and discharge into exhaust passages in the lower unit of the outboard motor, not shown. Web 25 formed between the two exhaust chambers 23 and webs 26 between the exhaust chambers 23 and their corresponding cylinder banks 17 form a core passageway 27 through the engine block. The core passageway 27 is blocked near its lower end by a dam 28, shown in broken line in FIG. 1, cast integrally with the block 11. The engine block 11 is sand cast from aluminum using sand cores. Each exhaust gas chamber 23 and its corresponding port extender passages 21 are formed using a single core. Thus the engine 10 is not susceptible to damage from water leakage into the exhaust system.

The crankcase 14 is divided into compartments 29, one for each cylinder 16, by the crank-disks 30 on the crankshaft 15 which support the crank pins 19. Each compartment 29 is provided with its own valved inlet passageway 31 to supply air-fuel mixture from carburetors, now shown, to be compressed in the crankcase compartments 29. From the crankcase 14 the air-fuel mixture is directed to the cylinders 16 via the transfer ports 32, 33 and 34, arranged to provide loop scavenging as taught in U.S. Pat. No. 4,092,958 to Hale.

Since operation of the engine 10 generates substantial heat, a water cooling system is provided with cooling passages arranged to provide a relatively even temperature distribution throughout the engine block 11 and cylinder heads 12. In the preferred embodiment, each cylinder bank 17 is provided with an outer wall 35 encircling the cylinder bank and closed by the heads 12 to define upper cylinder cooling jackets 36 surrounding the head end of each cylinder 16. The lower ends of the cylinders 16 are provided with outside cooling jackets 37 located adjacent the crankcase 14 on the outside of and cast integrally with the V-block 11. These outside cooling jackets 37 extend the vertical length of the engine 10 and serve to cool the lower ends of the cylinders 16 as well as provide substantial cooling to the crankcase 14 and transfer passages 32, 33 and 34, thereby increasing the volumetric efficiency of the pumping action in the crankcase chambers 29. On the inside of the engine block 11 the lower ends of the cylinders 16 are cooled by the central core cooling passage 27, defined by the exhaust chambers 23, the lower end of cylinders 16, and the transfer passages 33, 34 and 35. A cover 38 is provided above the exhaust gas chambers to define an exhaust manifold cooling chamber 39, and cylinder head cooling chambers 40 are provided in each cylinder head 12. Thus the major heat producing areas of the engine 10 are almost completely surrounded by water jackets and passages.

Figure 4:
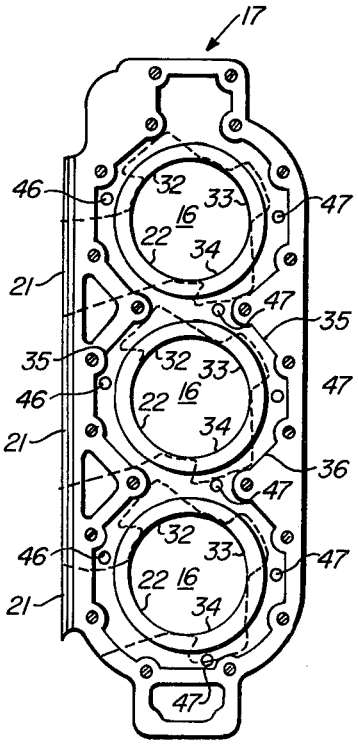
FIG. 4 is an end view of one cylinder bank with the head removed.
Figure 5:
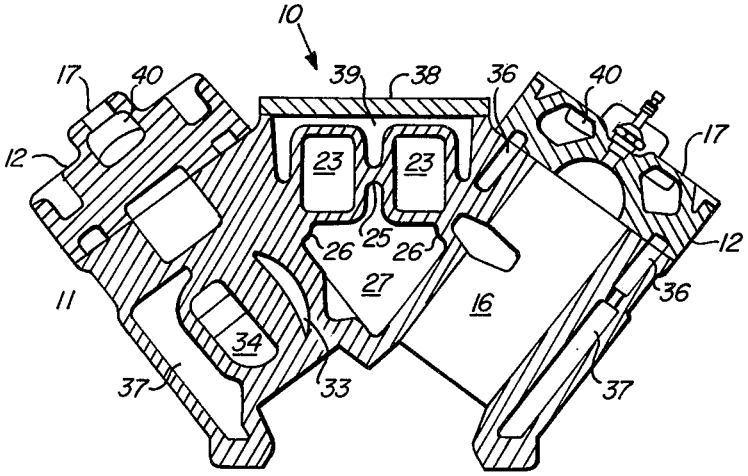
FIG. 5 is a section of the engine taken along line 5—5 of FIG. 1.

Cooling water is supplied to the engine by a conventional engine driven water pump 41, schematically illustrated in FIG. 6. The pump is connected by adapter plates 42, schematically shown in FIG. 6, to supply coolant to the engine 10. The coolant enters the engine 10 through the opening 43 at the bottom of the block below the dam 28, then flows through an opening 44 machined through the web 25 between the exhaust chambers into the exhaust manifold cooling jacket 39. After the cooling water is preheated in the manifold jacket 39, it exits the manifold jacket 39 near the top of the block 11 through drilled passages 45 into the common upper ends of the two outside cooling jackets 37 and into the central core cooling passage 27, shown most clearly in FIGS. 4 and 5.

From the central core 27 the coolant flows through passages 46 drilled through the wall separating the central core passages 27 from the upper cylinder jacket 36. The upper cylinder jacket 36 is also supplied with coolant through the passages 47 drilled through to the outside jacket 37. Though three passages 46 are shown in each cylinder bank 17 connecting the upper cylinder jacket 36 with the central core 27 and six passages connecting with the outside jackets 37 in the preferred embodiment, one of the features of the engine design is the flexibility in position and number of the drilled passages, thus allowing design flexibility in balancing the coolant flow through the engine. Further, the holes are drilled parallel to the cylinder axis for ease of fabrication. Thus a very open cooling system is provided which can be operated at significantly lower water pressure than comparable prior art engines. For example, the present engine would operate with a maximum water pressure of about 15 psi, compared to 20 psi in prior engines. This significantly increases water pump life as well as reduces the incidence of leakage.

From the upper cylinder water jackets 36 the coolant flows into the cylinder head cooling chambers 40. These chambers 40 are cast integrally with the head 12 to eliminate the possibility of leakage and are formed with passages encircling each combustion chamber and spark plug. The coolant leaves the heads 12 through the exit ports 48 and discharges through the adapter plate 42 and lower outboard motor unit, not shown.

I claim:

1. A unitary cast cylinder block for a water cooled, two-cycle crankcase compression outboard motor engine, said unitary block comprising:

A. a plurality of cylinders arranged in first and second vertical banks, said banks forming a V having an included angle of approximately 74°, each of said cylinders including an inlet port means for transferring inlet gases from a crankcase to the interior of said cylinders;

B. first and second vertical exhaust gas chambers between said cylinder heads, said exhaust gas chambers opening downwardly;

C. exhaust gas passages connecting each of said cylinders of said first and second banks with said first and second exhaust gas chambers, respectively;

D. walls between said exhaust gas chambers and said cylinders to define a vertically extending central core cooling passage;

E. first and second upper cylinder cooling jackets surrounding said cylinders at their head ends;

F. a manifold cooling passage partially defined between said first exhaust gas chamber and said first upper cylinder cooling jacket and between said second exhaust gas chamber and said second upper cylinder cooling jacket, said manifold cooling passages extending along the full length of said exhaust gas chambers; and G. first and second walls on the outside of said first and second cylinder banks, respectively, said walls spaced from said cylinders to define first and second outside cooling chambers on the outside of said V, said outside cooling chambers located near the apex of said V.

* * * * *